United States Patent [19]

Babichev et al.

[11] Patent Number: 5,031,963

[45] Date of Patent: Jul. 16, 1991

[54] METHOD OF DOWNHOLE HYDRAULICKING MINERAL RESOURCES

[76] Inventors: Nikolai I. Babichev, Bogorodsky val, 6, korpus 2, kv.432; Viktor A. Dmitriev, Moskvorechie, 35, korpus 3, kv.29; Grigory J. Abramov, ulitsa Udaltsova, 14,kv.44; Vladimir F. Paveliev, ulitsa Volgina, 8,kv.410, all of, Moscow, U.S.S.R.

[21] Appl. No.: 460,018

[22] Filed: Jan. 2, 1990

[51] Int. Cl.[5] ..... E21C 45/00

[52] U.S. Cl. ..... 299/17; 299/19

[58] Field of Search ..... 299/1, 10, 17, 19; 175/67

[56] References Cited

FOREIGN PATENT DOCUMENTS

| | | | |
|---|---|---|---|
| 611001 | 5/1978 | U.S.S.R. . | |
| 630421 | 9/1978 | U.S.S.R. . | |
| 928012 | 5/1982 | U.S.S.R. | 299/17 |
| 1346796 | 10/1987 | U.S.S.R. | 299/17 |
| 1346798 | 10/1987 | U.S.S.R. | 299/17 |

*Primary Examiner*—Ramon S. Britts
*Assistant Examiner*—David J. Bagnell
*Attorney, Agent, or Firm*—Lilling and Lilling

[57] ABSTRACT

A method of downhole hydraulicking mineral resources includes production panels being laid out at a deposit, holes being sunk in a longitudinal axis of each production panel, and device for hydraulicking mineral resources, comprising a monitor and a means of lifting pulp to the surface, being lowered into each of the holes. A mineral is broken hydraulically by a jet from the monitor, and the monitor jet being displaced at least once in a horizontal plane within confines of a main sector extending in a direction opposite to that in which a next hole is located, in radial working so that pillars are formed therebetween. An angle of each radial working is about the divergence angle of the jet of the monitor, and the angle the radial working make with each other is decided by the conditions of stability of the pillars between the radial workings during a period of driving a radial working.

9 Claims, 2 Drawing Sheets

METHOD OF DOWNHOLE HYDRAULICKING MINERAL RESOURCES

FIELD OF THE INVENTION

The present invention relates to mining and has specific reference to methods of downhole hydraulicking mineral resources.

The present invention may be of utility in mining deposits of unconsolidated and friable ore overlaid by unstable stratum, in developing occurences of titanium-zirconium ores, gold and diamold placers, in winning phosphate rock, mixture of sand and gravel for the building industry.

DESCRIPTION OF THE PRIOR ART

Widely known is a method of downhole hydraulicking mineral resources (SU; A; 611,001) involving the drilling of vertical holes located wherein are means of downhole hydraulicking mineral resources which consists of a monitor and a means of lifting pulp to the surface. The rock is broken by a jet issuing from the monitor of the means of hydraulicking mineral resources. Intersecting radial workings are so driven and the holes become thus interconnected. A point of intersection of two radial workings originating at a hole is spaced apart from the point of intersection of a pair of radial workings of a next hole by a distance which is less than the overburden roof subjected to natural caving. The rock contained between the radial workings is broken in heading towards the center. Pillars, which acquire starry configuration after mining the rock between three adjacent holes, are delineated and the rest of the rock in a room is broken between the radial workings and pillars.

In mining mineral resources occuring in unconsolidated productive beds overlaid by unstable strata, the caving of the overburden makes the hydraulicking possible only within the developed area of a sector without driving rooms and shaping pillars. As a result, the radius of breaking the rock and the recovery are at a minimum. The caving bringing about subsidence occur in close proximity to the hole, making it useless.

Also widely known is a method of downhole hydraulicking mineral resources (SU; A; 630,421) according whereto production panels are laid out at a deposit and holes are sunk in a longitudinal axis of each production panel. A means of hydraulicking mineral resources, -comprising a monitor and a means of lifting pulp to the surface, -is lowered into each hole, and the rock is broken by displacing the monitor of the means of hydraulicking within the confines of sectors in the form of rhombic rooms. Pillars are left between the rooms. Further breaking of the rock in each of the rooms takes place in heading towards the pillars from the rock in place until the roof caves in.

This method of downhole hydraulicking mineral resources is applicable when the productive bed and overburden consist of hard strata.

In mining mineral resources occuring in loose productive beds overlaid by unstable strata, rooms with a large area are cut which cause massive caving. The resulting subsidence directly within the zone around the hole make this unsuitable for further functioning. Apart from that, an extensive area of subsidence unavoidable in this case calls for spacing each succeeding hole widely apart from the preceding one so that much mineral resources are lost irrecoverably within the zone of the subsidence.

SUMMARY OF THE INVENTION

It is an object of the present invention to widen field of application of the downhole hydraulicking and render it suitable for working loose pay-out beds overlaid by unstable stratum.

The essence of the invention resides in a method of downhole hydraulicking mineral resources, pursuant whereto production panels are laid out at a deposit; holes are sunk in a longitudinal axis of each production panel; a means of hydraulicking mineral resources, comprising a monitor and a means of lifting pulp to the surface, is lowered into each of the holes; a mineral is hydraulically broken with a jet of the monitor of the means of hydraulicking mineral resources which displaces at least once in a horizontal plane within confines of a main sector extending in a direction opposite to that in which a next hole is located; and the pulp is lifted to the surface. According to the invention, the mineral is broken hydraulically with the jet of the monitor of the means of hydraulicking mineral resources in radial workings, each angle whereof is about the divergence angle of the jet of the monitor of the means of hydraulicking mineral resources, whereby pillars are formed between the radial workings. The angle the radial workings make with each other is decided by the conditions of stability of the pillars between the radial workings during a period of driving a radial working.

To increase the recovery of mineral, it is expedient to break hydraulically the mineral in each radial working until no more mineral disintegrates on a face of the radial working.

To prevent accidents at the surface in the vicinity of a hole before the mineral is broken hydraulically in radial working within the confines of the main sector, it is also expedient to excavate hydraulically additional sectors at boundaries of the main sector with an untapped mineral in place by displacing the monitor of the means by hydraulicking mineral resources in a horizontal plane through an angle which is substantially less than the angle of the main sector.

To prevent accidents at the surface in the vicinity of a hole, it is further expedient that an excavated thickness of the additional sectors be defined by the relationship $$m \leqq H(K_r - 1)$$

where m is an excavated thickness of a productive bed in metres;

H is the thickness of an overburden in metres and $K_r$ is the looseness factor of the overburden.

To prevent accidents at the surface in the vicinity of a hole, it is still expedient to sink each succeeding hole in the productive panel at a distance from the preceding hole which is greater than the distance travelled wherethrough from the preceding hole has a caving zone of the overburden by the time the hydraulicking from the succeeding hole is in progress.

The present invention realized by hydraulically breaking mineral in radial workings at a range which is greater than over before provides for increasing the recovery of mineral from each hole. The additional sectors, excavated hydraulically at the borders of the main sector with the untapped mineral in place, serve to attenuate the caving of the overburden and the subsidence at the surface, preventing accidents there. The fact that each succeeding hole is sunk outside the displacing caving zone provides for a working hole within the confines of the untapped mineral in place.

BRIEF DESCRIPTION OF THE DRAWINGS

The present invention will now be explained by describing a preferred embodiment thereof which should be read with reference to the accompanying drawings, wherein.

DETAILED DESCRIPTION OF THE INVENTION

The method of downhole hydraulicking mineral resources is operated as follows.

Figure 1:
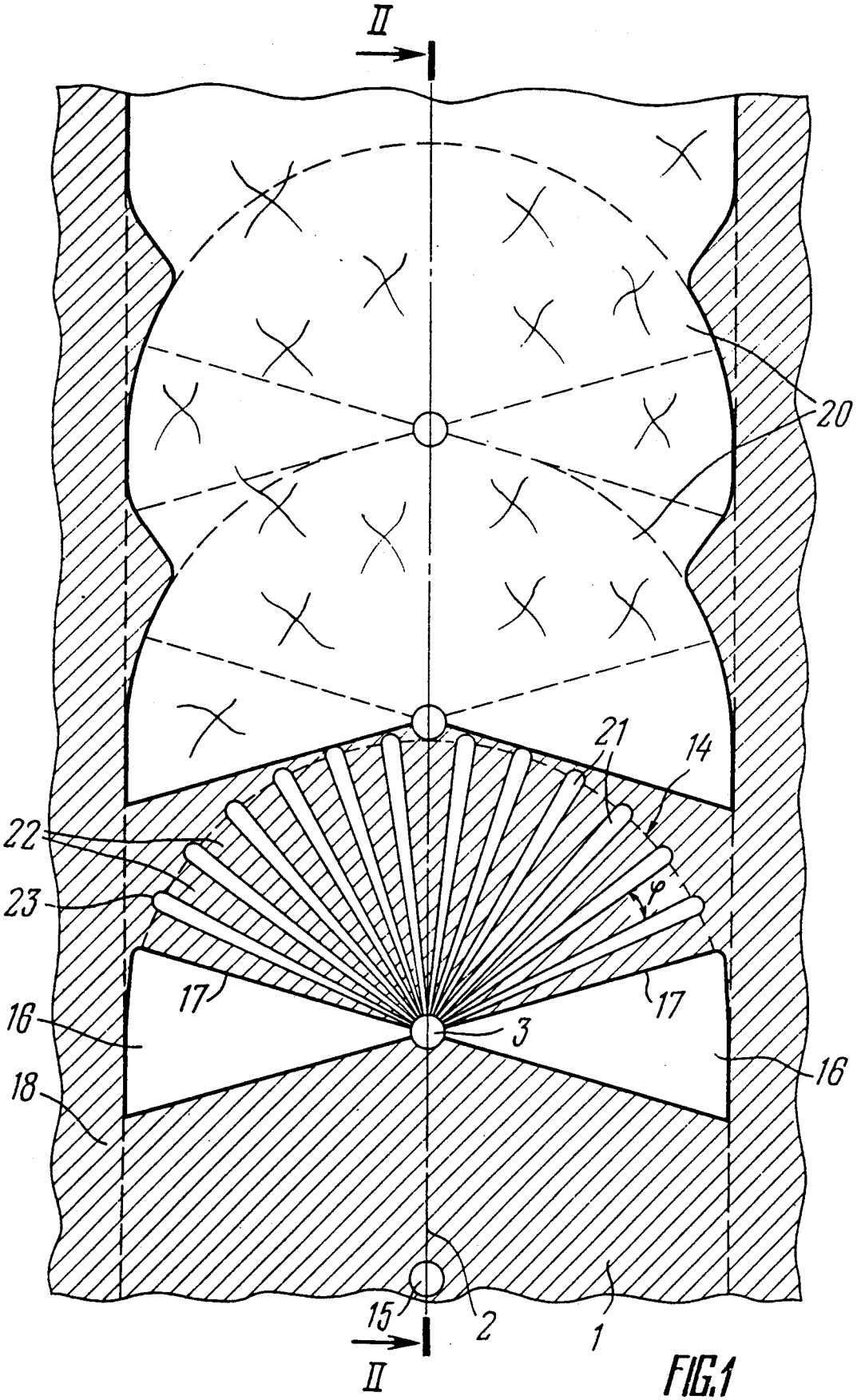
FIG. 1 is a plan view of a deposit developed in accordance with the invention.

Referring to FIG. 1, production panels 1 are laid out at the surface of a deposit to be developed, and holes 3 are sunk in a longitudinal axis 2 of each production panel 1 down to a level which is below a lower boundary 4 (FIG. 2) of a productive bed 5.

A casing 6 is installed in each hole 3 so that a lower end 7 thereof is level with an upper boundary 8 of the productive bed 5, and a casing-hole annulus 9 is cemented. A means 10 of hydraulicking mineral resources, consisting of a monitor 11 and a means 12 of lifting pulp to the surface provided in the form of a jet gun, is lowered into each hole 3. The monitor 11 of the means 10 is located level with the lower boundary 4 of the productive bed 5.

Mineral is broken hydraulically in the hole 3 by a jet 13 of the monitor 11 of the means 10 which is displaced at least once within confines of a main sector 14 (FIG. 1). The main sector 14 is hydraulically excavated from the hole 3 in a direction opposite to that in which a succeeding hole 15 is located. Preparatory to breaking the mineral in the main sector 14, hydraulic excavation of the mineral in two additional sectors 16 takes place which are located adjacent to the hole 3 at two borders 17 of the main sector 14 with an untapped mineral 18 in place. The additional sectors 16 are excavated by displacing the monitor 11 (FIG. 2) of the means 10 of hydraulicking mineral resources in a horizontal plane through angles of the additional sectors 16 which are each substantially less than the angle of the main sector 14. For example, the angle of each of the additional sectors is 16° to 20° and that of the main sector 14 is 160°. The excavated thickness of the additional sectors 16 is decided by the relationship $$m \leqq H(K_r - 1)$$

where m is an excavated thickness of the productive bed 5 in meters, H is the thickness of an overburden 19 in meters and $K_r$ is the looseness factor of the overburden 19.

The two additional sectors 16, which are adjacent to the hole 3 and delineate the main sector at the borders 17 with the untapped mineral 18 in place, are hydraulically excavated in order to provide space to cave in for the unstable overburden 19. The untapped mineral 18 in place is thus prevented from draw due to the pressure of the unstable overburden 19, e.g. sand, and retains stability over the entire period of breaking the mineral hydraulically in the delineated main sector 14.

Figure 2:
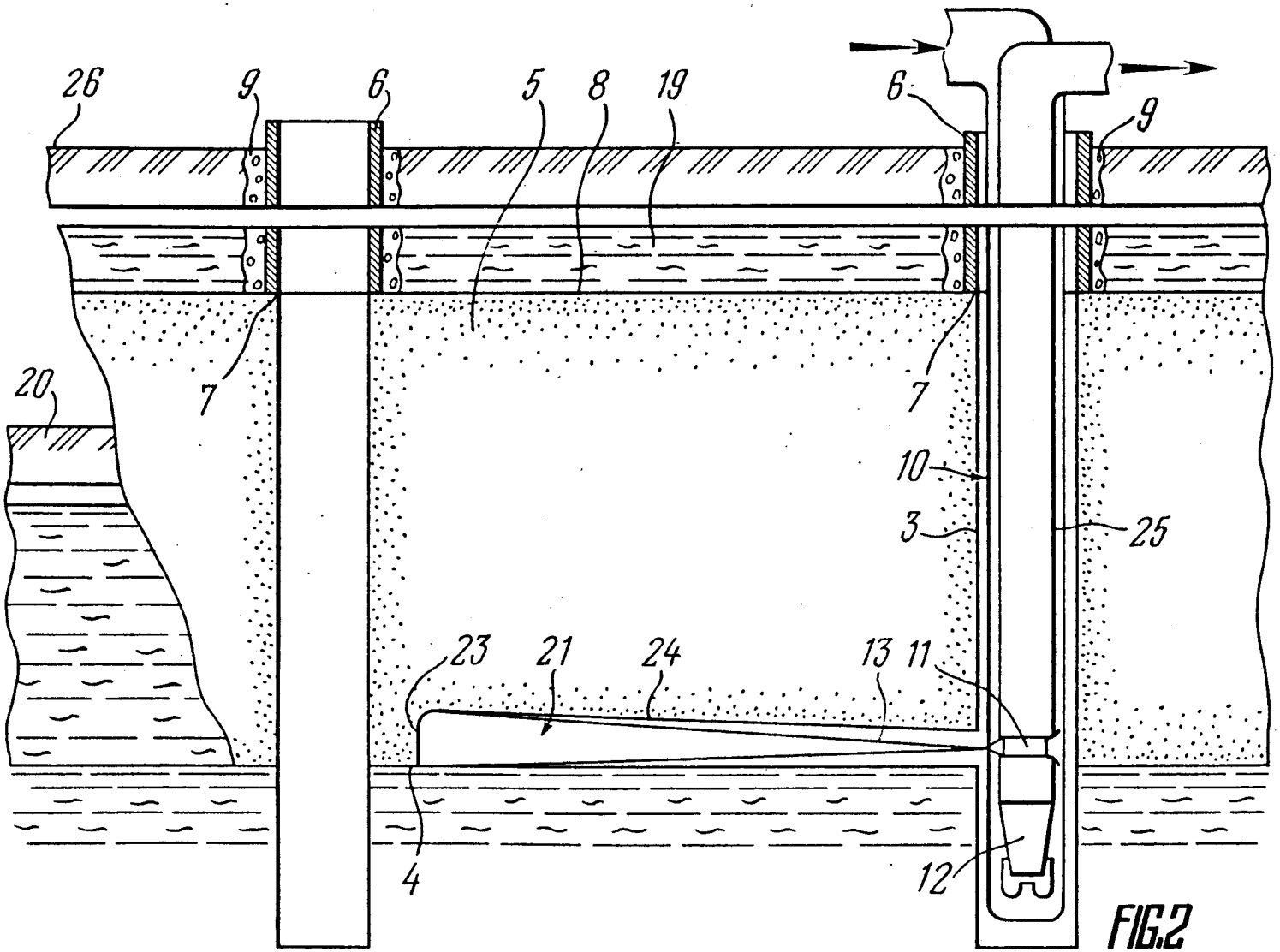
FIG. 2 is across sectional view taken along line II—II in FIG. 1.

The excavated thickness of the mineral in the additional sectors 16 equals, or is less than, the amount of loosiness of the overburden 19 (FIG. 2). This guarantees attenuation of a zone 20 of caving of the overburden 19 without working up to the surface and prevents emergency situations there.

The additional sectors 16, on being excavated, serve to relieve in a gradual way the pressure exerted by the untapped mineral 18 in place. As a result, stress concentrations set up due to rock pressure at the borders 17 of the main sector 14 with the untapped mineral 18 in place are at a minimum so that a sudden draw of the untapped mineral 18 in place towards the mined area of the main sector 14 is prevented.

On excavating the additional sectors 16, mining in the main sector 14 commences. To break the mineral within the confines of the main sector 14, radial working 21 (FIG. 1) separated by pillars 22 are driven hydraulically with the aid of the jet 13 of the monitor 11 of the means 10. Each of the radial working 21 is being drifted by pointing the monitor 11 (FIG. 2) of the means 10 in a given direction until no mineral is disintegrated on a face 23 of the radial working 21. After that, the monitor 11 of the means 10 is turned through an angle $\phi$ (FIG. 1) selected so as to ensure stability of the pillars 22 between the radial workings 21 during the period of drifting the radial workings 21, and the drifting of the next radial working 21 begins.

The optimum angle $\phi$ the radial workings 21 make with each other is between 10° and 40°. By carrying on with the drifting of each radial working 21 until no mineral disintegrates on the face 23 of the radial working 21, the productive bed 5 (FIG. 2) is worked through a maximum distance from the hole 3 which depends on the strength of the mineral in the productive bed 5. This approach ensures maximum recovery of the mineral and increases the rate of output of mineral resources. The radial workings 21 provide for breaking the mineral of the productive bed 5 at a maximum distance from the hole 3, for a roof 24 of each radial working 21 is cleared within a minimum area and displays a maximum stability. The consecutive drifting of the radial workings 21 makes for a gradual yield of the overburden 19, for a friable ore, e.g. ore fines, of the productive bed 5 contained in the pillars 22 (FIG. 1) and displaces into the developed radial workings 21 due to rock pressure. Sudden caving in of the roof 24 (FIG. 2) of the radial workings 21 is excluded in this case. The caving zone 20 gradually works up to the surface as soon as it originates at the roof 24 of a radial working 21. The angle of the main sector 14 (FIG. 1) is 90°-240° and that of each of the additional sectors 16 is 5°-15° depending on the physical and mechanical properties of the ore of the productive bed 5 (FIG. 2) and the overburden 19.

The main sector 14 (FIG. 1) is given an angle of 240° in those cases when the overburden 19 is of a stable kind capable of retaining stability during the period of working the hole 3 hydraulically.

The main sector 14 is given an angle of 90° when an unstable overburden 19 (FIG. 2) is met with. The border between the untapped mineral 18 (FIG. 1) in place and the zone of development around the hole 3 acquires then a configuration which ensures maximum stability and safeguards the hole 3 against a draw of the untapped mineral 18 in place towards caved area 20.

The rock is broken hydraulically from the radial workings 21 within the confines of the main sector 14 (FIG. 1) by displacing the monitor 11 (FIG. 2) of the means 10 of hydraulicking mineral resources at least once in a horizontal plane. On breaking a stratum of the rock within the confines of the main sector 14 (FIG. 1), the monitor 11 (FIG. 2) is returned into its initial position and the hydraulic mining is carried on within the confines of the main sector 14 (FIG. 1) on the same lines as described hereinabove. In breaking each stratum within the confines of the main sector 14, the ore of the productive bed 5 (FIG. 2) displaces into the openings formed by the radial workings 21 and fills them. Thus, every repeated cycle of hydraulicking within the confines of the main sector 14 (FIG. 1) provides for a steady recovery of the ore lifted to the surface. If no ore disingegrates after a next cycle of hydraulic mining within the confines of the main sector 14, the monitor 11 (FIG. 2) of the means 10 is set so that the jet 13 of the monitor 11 of the means 10 impinges upon a pillar 22 (FIG. 1) formed between radial workings 21 in mining the preceding stratum of ore.

The robbed pillar 22 displaces into the opening formed by the radial workings 21, and the hydraulic mining continues. The pulp is lifted to the surface over a pipe 25 (FIG. 2) of the means 10 of hydraulicking mineral resources. Each succeeding hole 15 is sunk in the production panel 1 (FIG. 1) at a distance from the preceding hole 3 (FIG. 2) which is greater than the distance travelled wherethrough from the preceding hole 3 has a border 26 of the caving zone 20 of the overburden 19 by the time when the hydraulicking from the succeeding hole 15 is in progress.

Accordingly, each succeeding hole 15 of the production panel 1 (FIG. 1) is located beyond the border 26 (FIG. 2) of the caving zone 20 at a distance which varies with the rheological properties of the overburden 19. The period of time required by the caving zone 20 to cover the distance to the next hole 15 in travelling towards the untapped mineral 18 in place can be calculated. The mining from the hole 3 comes to an end before the caving zone 20 (FIG. 1) reaches this hole.

When the caving zone 20 works up to the surface, the means 10 of hydraulicking mineral resources is dismantled and transferred from the hole 3 into the next hole for operation.

The present invention provides for efficient mining loose productive beds, e.g. these of quartz sand, overlaid by unstable overburden and increases the recovery of mineral resources.

What is claimed is:

1. A method of downhole hydraulicking mineral resources consisting in:

laying out production panels having each a longitudinal axis at a deposit;

sinking holes in said longitudinal axis of each said production panel;

installing a means of hydraulicking mineral resources, comprising a monitor and a means of lifting pulp to the surface, in each said hole;

hydraulically breaking a mineral by a jet of said monitor of said means of hydraulicking mineral resources in radial workings so that pillars are formed between radial workings;

displacing said jet of said monitor of said means of hydraulicking mineral resources at least once in a horizontal plane within confines of a main sector extending in a direction opposite to that in which a succeeding hole is located; said hydraulic breaking of the mineral carried out by driving radial workings, having each a face and an angle, so that pillars are formed between said radial workings; whereby an angle of each said radial working approximately equals a divergence angle of said jet of said monitor of said means of hydraulicking mineral resources and an angle said radial workings make with each other is decided by the condition of stability of said pillars between said radial workings during a period of hydraulically driving said radial working; and lifting pulp which is formed to the surface.

2. A method as claimed in claim 1, wherein said hydraulic breaking of the mineral by said jet of said monitor of said means of hydraulicking mineral resources in each said radial working is carried on until no more mineral is disintegrated on said face of said radial working.

3. A method as claimed in claim 2, wherein preparatory to said hydraulic breaking of the mineral by said radial workings within the confines of said main sector, additional sectors, - located at borders of said main sector with untapped mineral in place, - are hydraulically excavated by displacing said monitor of said means of hydraulicking mineral resources in a horizontal plane; said additional sectors having each an angle which is substantially less than an angle of the main sector.

4. A method as claimed in claim 3, wherein an excavated thickness of said additional sectors is defined by the relationship $$m \leqq H(K_r - 1)$$

where m is an excavated thickness of a productibe bed in meters; H is the thickness of the overburden in meters and $K_r$ is the looseness factor of the overburden.

5. A method as claimed in claim 2, wherein each succeeding said hole is sunk in said production panel at a distance from a preceding said hole which is greater than a distance travelled wherethrough from said preceding hole has a caving zone of qn overburden by the time when the hydraulicking from said succeeding hole is in progress.

6. A method as claimed in claim 1, wherein preparatory to said hydraulic breaking of the mineral by said radial workings within the confines of said main sector, additional sectors, located at borders of said main sector with untapped mineral in place, are hydraulically excavated by displacing said monitor of said means of hydraulicking mineral resources in a horizontal plane; said additional sectors having each an angle which is substantially less than an angle of the main sector.

7. A method as claimed in claim 6, wherein an excavated thickness of said additional sectors is defined by the relationship $$m \leqq H(K_r - 1)$$

where m is an excavated thickness of a productive bed in metres;

H is the thickness of an overburden in meters and $K_r$ is the looseness factor of the overburden.

8. A method as claimed in claim 6, wherein each succeeding said hole is sunk in said production panel at a distance from a preceding said hole which is greater than a distance travelled wherethrough from said preceding hole has a caving zone of an overburden by the time when the hydraulicking from said succeeding hole is in progress.

9. A method as claimed in claim 1, wherein each said succeeding hole is sunk in said production panel at a distance from a preceding said hole which is greater than a distance travelled wherethrough from said preceding hole has a caving zone of an overburden by the time when the hydraulicking from said succeeding hole is in progress.

* * * * *